US012674256B2

(12) United States Patent
Dassanayake et al.

(10) Patent No.: US 12,674,256 B2
(45) Date of Patent: Jul. 7, 2026

(54) FABRIC WITH FLUID ABSORPTION CAPABILITIES

(71) Applicant: MAS Innovation (Private) Limited, Battaramulla (LK)

(72) Inventors: Sithila Ayomi Dassanayake, Battaramulla (LK); Dilru Roshan Ratnaweera, Battaramulla (LK); Hetti Arachchige Malaka Chathu Perera, Battaramulla (LK); Indika Sanjeewa Wickramaratne Dodangodage, Battaramulla (LK)

(73) Assignee: MAS Innovation (Private) Limited, Battaramulla (LK)

( * ) Notice: Subject to any disclaimer, the term of this patent is extended or adjusted under 35 U.S.C. 154(b) by 243 days.

(21) Appl. No.: 18/554,451

(22) PCT Filed: Mar. 24, 2022

(86) PCT No.: PCT/GB2022/050749

§ 371 (c)(1),
(2) Date: Oct. 6, 2023

(87) PCT Pub. No.: WO2022/214781

PCT Pub. Date: Oct. 13, 2022

(65) Prior Publication Data

US 2024/0191405 A1 Jun. 13, 2024

(30) Foreign Application Priority Data

Apr. 7, 2021 (GB) ..... 2104916

(51) Int. Cl.
*D04B 1/12* (2006.01)

(52) U.S. Cl.
CPC ..... *D04B 1/12* (2013.01); *D10B 2401/021* (2013.01); *D10B 2401/022* (2013.01); *D10B 2403/0212* (2013.01)

(58) Field of Classification Search
None
See application file for complete search history.

(56) References Cited

U.S. PATENT DOCUMENTS 7,556,553 B2 * 7/2009 Falla ..... A41C 5/005 450/39
2004/0168479 A1 * 9/2004 McMurray ..... D04B 1/16 66/202

(Continued)

FOREIGN PATENT DOCUMENTS

CN 202000067 * 10/2011
CN 202000067 U 10/2011

(Continued)

OTHER PUBLICATIONS

Machine Translation of CN202000067 (Year: 2011).*
Machine Translation of CN108532104 (Year: 2018).*

*Primary Examiner* — Shawn Mckinnon
(74) *Attorney, Agent, or Firm* — Knobbe, Martens, Olson & Bear, LLP

(57) ABSTRACT

A fabric with fluid absorption capabilities is provided. The fabric includes a first layer, a second layer, and a spacer yarn. The first layer includes a hydrophobic yarn, and the second layer includes a hydrophilic yarn and a reinforcement yarn plied together. The hydrophobic yarn, the hydrophilic yarn, and the reinforcement yarn form a plurality of valleys on an upper surface of the first layer. The spacer yarn is configured to connect the first layer and the second layer.

20 Claims, 3 Drawing Sheets

(56) References Cited

U.S. PATENT DOCUMENTS

| | | | | |
|---|---|---|---|---|
| 2009/0104404 | A1 | 4/2009 | Polegato Moretti | |
| 2020/0094514 | A1* | 3/2020 | Harage | D02G 3/28 |
| 2020/0267929 | A1 | 8/2020 | Lee et al. | |

FOREIGN PATENT DOCUMENTS

| | | | |
|---|---|---|---|
| CN | 108532104 | * | 9/2018 |
| CN | 112226888 | A | 1/2021 |
| DE | 10055902 | A1 | 6/2001 |
| EP | 3533371 | A1 | 9/2019 |
| GB | 2104916.8 | A | 10/2022 |
| WO | 2022-214781 | A1 | 10/2022 |

* cited by examiner

FABRIC WITH FLUID ABSORPTION CAPABILITIES

CROSS-REFERENCE TO RELATED APPLICATIONS

This patent application claims the benefit of British Application No. GB2104916.8, filed Apr. 7, 2021, and PCT Application No. PCT/GB2022/050749, filed Mar. 24, 2022, the disclosures of which are incorporated by reference herein in their entireties.

TECHNICAL FIELD

The present disclosure relates to a fabric, and more particularly, to a fabric with fluid absorption capabilities and method of manufacturing the fabric.

BACKGROUND

With the advancement of technology, there have been significant improvements in textile fabrics, more specifically in fluid and moisture management. With the increase in the need for easy and quick drying of wet areas without forming patches of fluid or moisture on the surface of a fabric, the use of a multi-composite textile fabric has been approached. The multi-composite textile fabric includes various individual materials having different functionalities. The use of multi-composite textile fabric may add to benefits of comfort and hygiene to the wearer, more particularly in sportswear clothing, diapers, and garments.

The multi-composite textile fabric has been applied towards the purpose of quick absorption of moisture and fluid. Some attempts at manufacturing the multi-composite textile fabrics require additional materials such as polymeric absorbents, absorbent non-woven, absorbing crystals, and hydrophobic coatings. However, the inclusion of such additional materials adds more complexity, cost, and additional time to the process of fabric manufacturing. Moreover, several multi-composite textile fabrics lack the capabilities of efficient fluid absorption and channeling in addition to rapid wear and tear, resulting in substantially diminished wash durability, performance, and effectiveness.

SUMMARY

According to one aspect of the present disclosure, a fabric is disclosed. The fabric includes a first layer, a second layer distal to the first layer, and a spacer yarn configured to connect the first layer and the second layer. The first layer includes a hydrophobic yarn. The second layer includes a hydrophilic yarn and a reinforcement yarn. The hydrophilic yarn and the reinforcement yarn are plied together. The hydrophobic yarn, the hydrophilic yarn, and the reinforcement yarn are together configured to define a plurality of valleys on an upper surface of the first layer. In an embodiment, the fabric includes an absorbent layer disposed between the first layer and the second layer. The absorbent layer includes cotton, rayon, or a combination thereof. In one embodiment, the reinforcement yarn is an elastomeric yarn. In another embodiment, the reinforcement yarn is a shrinkage yarn.

In an embodiment, the fabric includes a plurality of loops. A cross-sectional area of the valley is at least equal to a cross-sectional area defined by one loop of the plurality of loops. In one embodiment, a material of the first layer includes polyester, nylon, polypropylene, viscose, acrylic, cotton, wool, or a combination thereof. In another embodiment, a material of the second layer includes polyester, nylon, polypropylene, viscose, acrylic, cotton, wool, or a combination thereof. In yet another embodiment, a material of the spacer yarn includes polyester, nylon, polypropylene, viscose, acrylic, cotton, wool, or a combination thereof. In one embodiment, the spacer yarn is hydrophobic. In another embodiment, the spacer yarn is hydrophilic. In an embodiment, the fabric having a thickness defined between the first layer and the second layer is in a range of about 1 mm to 12 mm.

In another aspect of the present disclosure, a method of making a fabric is disclosed. The method includes knitting a hydrophobic yarn to form a first layer and knitting a hydrophilic yarn and a reinforcement yarn together to form a second layer. The method further includes connecting the first layer and the second layer using a spacer yarn and forming a plurality of valleys on an upper surface of the first layer. The hydrophobic yarn, the hydrophilic yarn, and the reinforcement yarn together define the plurality of valleys. In an embodiment, the method includes inlaying an absorbent layer between the first layer and the second layer.

In one embodiment, the method of making the fabric includes, swapping a plurality of stitches between the first layer and the second layer at predefined locations to form the plurality of valleys. The reinforcement yarn is an elastomeric yarn, and the plurality of stitches between the hydrophobic yarn and the elastomeric yarn are swapped at the predefined locations. In another embodiment, the method of making the fabric includes applying a stimulus on the reinforcement yarn to form the plurality of valleys in which the reinforcement yarn is a shrinkage yarn. In yet another embodiment, the method of making the fabric includes reducing a loop length of the hydrophilic yarn with respect to a loop length of the hydrophobic yarn to form the plurality of valleys.

Other features and aspects of this disclosure will be apparent from the following description and the accompanying drawings.

BRIEF DESCRIPTION OF DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claim.

Figure 1:
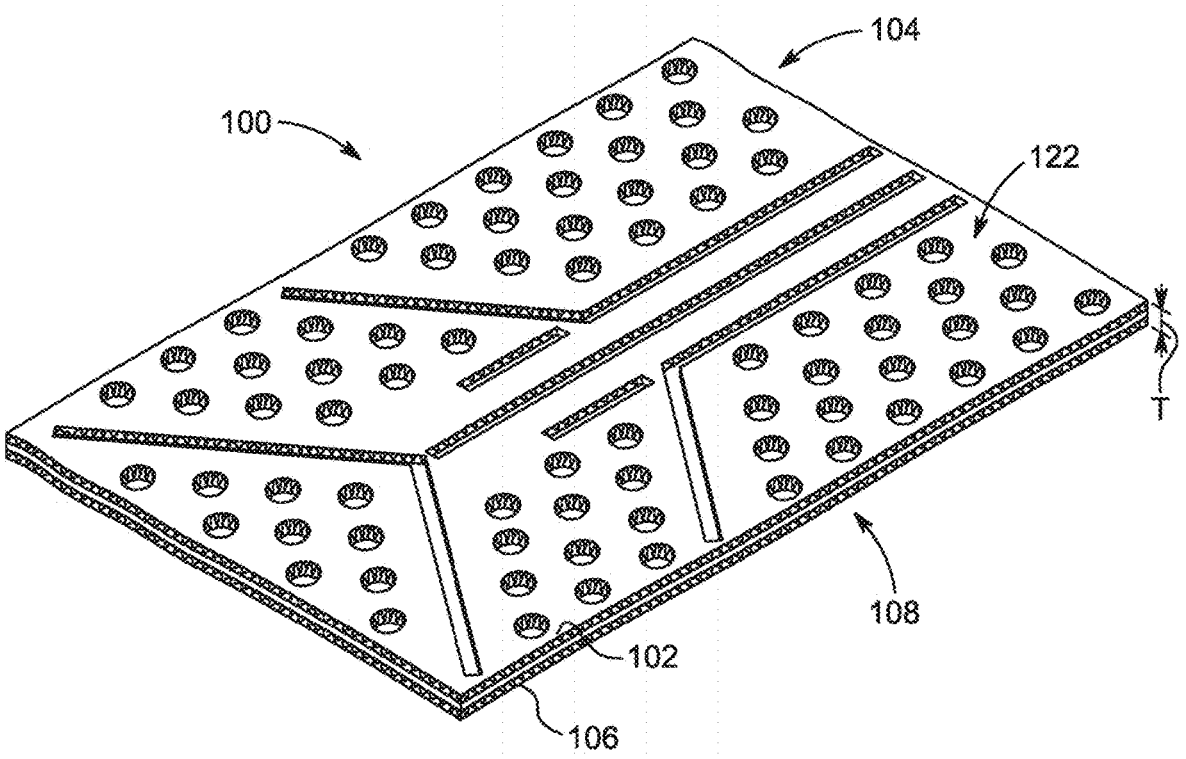
FIG. 1 is a schematic top perspective view of a fabric having valleys, according to an embodiment of the present disclosure.

Referring to FIG. 1, a top perspective view of a fabric 100 is illustrated, according to an embodiment of the present disclosure. The fabric 100 includes a first layer 102 on an upper side 104 of the fabric 100 and a second layer 106 on a bottom side 108 of the fabric 100. The first layer 102 includes a hydrophobic yarn 110 and the second layer 106 includes a hydrophilic yarn 112 and a reinforcement yarn 114. The hydrophilic yarn 112 and the reinforcement yarn 114 are plied together. In an embodiment, the hydrophilic yarn 112 and the reinforcement yarn 114 may be plied together using techniques including, but not limited to, regular plying, navajo plying, machine plying, or any known plying techniques to combine two or more yarns. The hydrophobic yarn 110 is used to repel or migrate liquid from its surface or in the vicinity to keep the first layer 102 of the fabric 100 dry or moisture-free. In an embodiment, the first layer 102 is made of materials including, but not limited to, polyester, nylon, polypropylene, viscose, acrylic, cotton, wool, or a combination thereof. The hydrophobic yarn 110 is obtained as a result of chemically treating a yarn of the first layer 102 to give the hydrophobic property. The hydrophilic yarn 112 is used to attract or absorb the liquid from the vicinity into the core of the hydrophilic yarn 112. In an embodiment, the second layer 106 is made of materials including, but not limited to, polyester, nylon, polypropylene, viscose, acrylic, cotton, wool, or a combination thereof. The hydrophilic yarn 112 is obtained as a result of chemically treating a yarn of the second layer 106 to give the hydrophilic property. In one embodiment, the reinforcement yarn 114 is an elastomeric yarn. In another embodiment, the reinforcement yarn 114 is a shrinkage yarn.

The hydrophobic yarn 110, the hydrophilic yarn 112, and the reinforcement yarn 114 are together configured to define a plurality of valleys 120 on an upper surface 122 of the first layer 102. In an embodiment, the reinforcement yarn 114 is an elastomeric yarn, in such a case, a single valley 120 may be formed by swapping a plurality of stitches between the first layer 102 and the second layer 106 at predefined locations. The valleys 120 formed by swapping the stitches can act as a pathway for liquid or moisture to accelerate its flow from the upper surface 122 of the first layer 102 to the second layer 106. The valleys 120 are present at a level lower than the upper surface 122 of the first layer 102 because of the elastic properties associated with the reinforcement yarn 114. The plurality of valleys 120 at various predefined locations on the upper surface 122 of the fabric 100 make the removal of fluid faster and more effective as the first layer 102 being hydrophobic in nature guides the fluid from its vicinity towards the valleys 120. Through the valley 120, the fluid is wicked to the second layer 106 due to the presence of the hydrophilic yarn 112 and the fluid spreads across a surface of the second layer 106. Due to a larger surface area of the second layer 106, the fluid gets evaporated in the environment.

Figure 2:
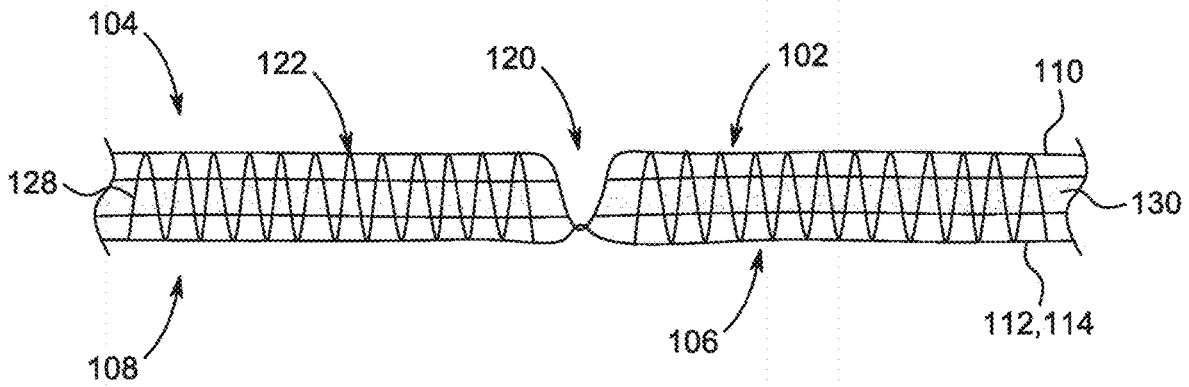
FIG. 2 is a schematic cross-sectional view of the fabric, according to an embodiment of the present disclosure.

Referring to FIG. 2, a schematic cross-sectional view of the fabric 100 is illustrated, according to an embodiment of the present disclosure. The fabric 100 includes a spacer yarn 128 configured to connect the first layer 102 and the second layer 106. In an embodiment, the spacer yarn 128 may connect the first layer 102 and the second layer 106 using techniques including, but not limited to, stitching, knitting, weaving, or sticking. The spacer yarn 128 is made of materials including, but not limited to, polyester, nylon, polypropylene, viscose, acrylic, cotton, wool, or a combination thereof. In one embodiment, the spacer yarn 128 is hydrophobic. In another embodiment, the spacer yarn 128 is hydrophilic. In some embodiments, the spacer yarn 128 may be hydrophobic or hydrophilic depending on the application of the fabric 100. The use of hydrophilic spacer yarn may ensure greater fluid wicking capabilities for the fabric 100. The hydrophobic or the hydrophilic property of a yarn is obtained as a result of chemically treating the yarn with hydrophobic or hydrophilic materials.

The fabric 100 further includes an absorbent layer 130 disposed between the first layer 102 and the second layer 106. The absorbent layer 130 is used for absorbing or wicking the moisture from the first layer 102 via the valleys 120 to the second layer 106 of the fabric 100. In an embodiment, the absorbent layer 130 includes cotton, rayon, or a combination thereof. Alternatively, the absorbent layer 130 may be made of any hydrophilic material with high absorbency. In some embodiments, implementation of the absorbent layer 130 in the fabric 100 may be subjected to the application of the fabric 100.

In an embodiment, the second layer 106 is distal to the first layer 102. The fabric 100 has a thickness 'T' defined between the first layer 102 and the second layer 106 and the thickness 'T' is in a range of about 1 mm to 12 mm. The varying thickness of the fabric 100 between 1 mm and 12 mm may depend upon the inclusion of the absorbent layer 130 and the application of fabric 100. The inclusion of the absorbent layer 130 for enhancing the absorbing capacity of the fabric 100 will result in a thick fabric compared to fabric without the absorbent layer 130. Due to the presence of the valleys 120, fluid droplets get easily absorbed into the absorbent layer 130 of the fabric 100 thus causes lateral wetting of the absorbent layer 130 which further increases wicking or absorption of fluid in the second layer 106 in short time compared to fabric without the absorbent layer 130.

Figure 3:
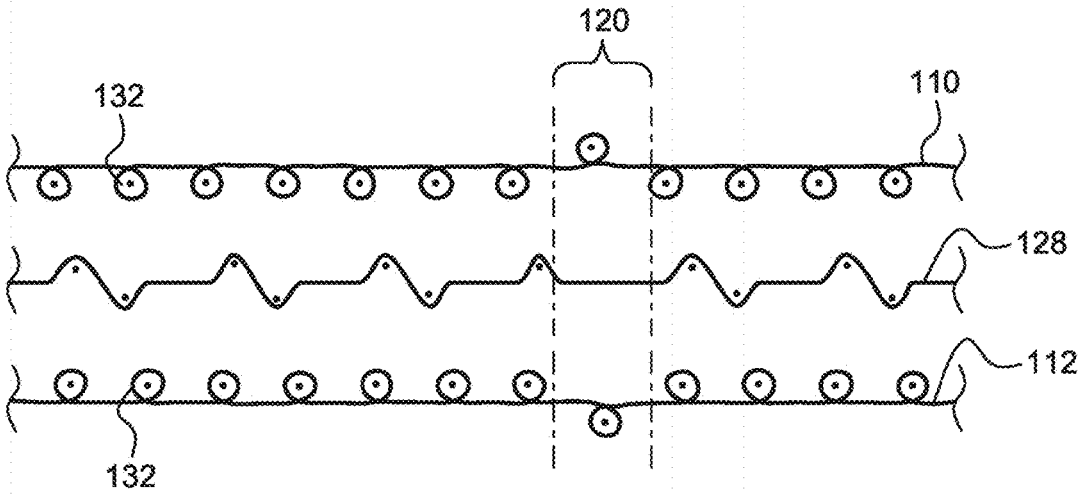
FIG. 3 is a schematic exploded view showing exemplary loop design of yarns of the fabric, according to an embodiment of the present disclosure.

Referring to FIG. 3, a schematic exploded view showing exemplary loop design of the hydrophobic yarn 110, the hydrophilic yarn 112, and the reinforcement yarn 114 of the fabric 100 is illustrated, according to an embodiment of the present disclosure. Each of the hydrophobic yarn 110, the hydrophilic yarn 112 and the reinforcement yarn 114 includes a plurality of loops 132. The plurality of loops 132 is alternatively referred to as 'the loop 132', 'the loops 132', or 'one loop 132'. In an embodiment, a cross-sectional area of the valley 120 is at least equal to a cross-sectional area defined by one loop of the plurality of loops 132. In an embodiment, one loop 132 of each of the hydrophobic yarn 110, the hydrophilic yarn 112 and the reinforcement yarn 114 may be configured to form the valley 120. Particularly, each of the first layer 102 and the second layer 106 of the fabric 100 includes the plurality of loops 132. Each of the first layer 102 and the second layer 106 may follow the same pattern of loops 132 all around the fabric 100 except for the predefined locations where the valleys 120 are present. In one implementation, the hydrophobic yarn 110 may have an inverse loop at the predefined location of the valleys 120 compared to the rest of the locations. Similarly, the hydrophilic yarn 112 may have an inverse loop at the predefined location of the valleys 120 compared to the rest of the locations. In some embodiments, the plied configuration of the hydrophilic yarn 112 and the reinforcement yarn 114 may have an inverse loop at the predefined location of the valleys 120 compared to the rest of the locations. The spacer yarn 128 may be devoid of loop at the location of the valleys 120.

Figure 4:
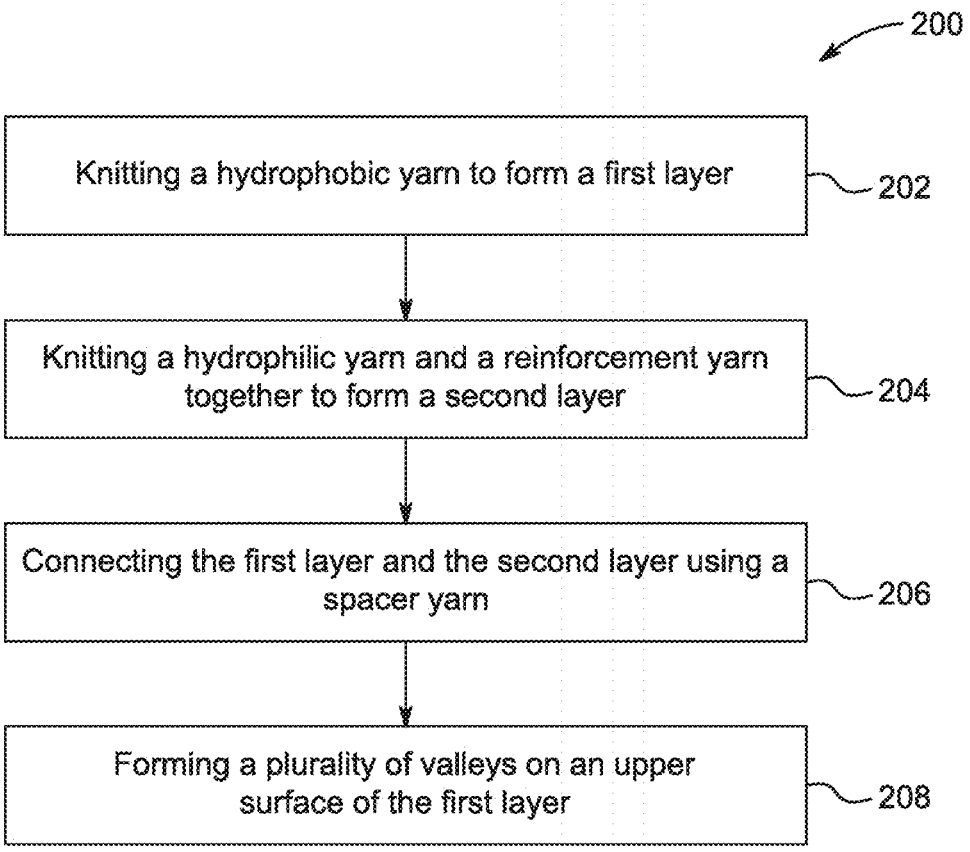
FIG. 4 is a schematic flow diagram of a method of making the fabric, according to an embodiment of the present disclosure.

Referring to FIG. 4, a schematic flow diagram of a method 200 of making the fabric 100 is illustrated, according to an embodiment of the present disclosure. The method 200 of making the fabric 100 is described with reference to the fabric 100 illustrated in FIG. 1 and FIG. 2. At step 202, the method 200 includes knitting the hydrophobic yarn 110 to form the first layer 102. The knitting of the hydrophobic yarn 110 is performed by techniques including, but not limited to, weft knitting, warp knitting, knit and purl stitching, and plaited stitching. At step 204, the method 200 includes knitting the hydrophilic yarn 112 and the reinforcement yarn 114 together to form the second layer 106. The hydrophilic yarn 112 and the reinforcement yarn 114 may be plied together using techniques including, but not limited to, regular plying. Navajo plying, machine plying, or any known plying techniques to combine two or more yarns. Further, the plied yarn is knitted to form the second layer 106 by using techniques including, but not limited to, weft knitting, warp knitting, knit and purl stitching, and plaited stitching. At step 206, the method 200 includes connecting the first layer 102 and the second layer 106 using the spacer yarn 128. The spacer yarn 128 may connect the first layer 102 and the second layer 106 using techniques including, but not limited to, stitching, knitting, weaving, or sticking. At step 208, the method 200 includes forming the plurality of valleys 120 on the upper surface 122 of the first layer 102. In an embodiment, the hydrophobic yarn 110, the hydrophilic yarn 112, and the reinforcement yarn 114 together define the plurality of valleys 120.

The method 200 of making the fabric 100 further includes swapping the plurality of stitches between the first layer 102 and the second layer 106 at the predefined locations to form the plurality of valleys 120. In such a case, the reinforcement yarn 114 is the elastomeric yarn and the plurality of stitches between the hydrophobic yarn 110 and the elastomeric yarn are swapped at the predefined locations. In an embodiment, swapping of stitches is performed by various techniques including, but not limited to, knitting, sewing, and weaving. Swapping stitches between the first layer 102 and the second layer 106 may allow an overlap of the second layer 106 over the first layer 102, which in turn may expose the hydrophilic yarn 112 on the upper surface 122 of the fabric 100. In an embodiment, swapping can be done by inversing the knitting pattern, that is by introducing a back knit loop on the first layer 102 and a front knit loop on the second layer 106 at the predefined locations to form the plurality of valleys 120. The elastomeric yarn in the second layer 106 may pull the swapped stitches below the level of the upper surface 122 of the first layer 102, thereby form a depression on the upper surface 122 of the first layer 102 to define the valleys 120.

In another embodiment, the reinforcement yarn 114 may be made of the shrinkage yarn which may be subjected to a stimulus to form the plurality of valleys 120. In an embodiment, the stimulus can be a process including, but not limited to, steam application, relaxation drying, and a chemical treatment. The application of the stimulus to the shrinkage yarn may form the depression on the upper surface 122 of the fabric 100 to form the valleys 120. The valleys 120 allow the liquid droplets to get absorbed in the fabric 100 by exposing the liquid droplets to the hydrophilic yarn 112 present in the valleys 120.

In yet another embodiment, the method 200 of making the fabric 100 includes reducing a loop length of the hydrophilic yarn 112 with respect to a loop length of the hydrophobic yarn 110 to form the plurality of valleys 120. The reduced loop length of the hydrophilic yarn 112 may move the swapped stitches closer to the second layer 106 thus creating depression on the upper surface 122 of the fabric 100. In an embodiment, the method 200 of making the fabric 100 includes inlaying the absorbent layer 130 between the first layer 102 and the second layer 106. The absorbent layer 130 may act as a high moisture absorbency layer between the first layer 102 and the second layer 106. The absorbent layer 130 can be hydrophilic or hydrophobic depending on the end-use application.

The method 200 of making the fabric 100, according to the present disclosure, produces the fabric 100 in a single manufacturing step by feeding all the yarns together in the process without having any additional manufacturing step or the need for additional assembly step, thereby making the integration of the layers of the fabric 100 seamless. Thus, the method 200 simplifies the making of the fabric 100 by minimizing the manufacturing steps, which further decreases the manufacturing time and cost. The fabric 100 further provides better reusability, durability, ease of dryness, and moisture management. The fabric 100 having distinct layers acts as a one-way liquid transport system that allows the fluid to transport from the first layer 102 to the second layer 106 and not vice versa in any condition. The use of the absorbent layer 130 is advantageous in holding the fluid in the fabric 100.

The fabric 100 is used in applications where there is a need for quick absorption of fluid and giving a sense of dryness to the user. Examples of such applications are sports apparel where the first layer 102 comprising the hydrophobic yarn 110 is in contact with the skin of the user, and when the user discharges sweat, it easily gets channeled away from the skin and from the first layer 102 thereby giving a dry and hygienic feel to the user. Another example is the use of fabric 100 in diapers and sanitary pads where the fluid discharge of the body is easily absorbed and enhances the comfort of the user. In another implementation, the user may use the fabric 100 by exposing their skin to the second layer 106 containing hydrophilic yarn 112 further keeping the first layer 102 containing hydrophobic yarn 110 outside. The advantage of wearing the cloth in such a manner may not allow wet patches to be formed on the outer surface of the fabric 100 keeping it moisture-free and dry.

While aspects of the present disclosure have been particularly shown and described with reference to the embodiments above, it will be understood by those skilled While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

The invention claimed is:

1. A fabric comprising:

a first layer comprising a hydrophobic yarn;

a second layer distal to the first layer, and comprising a hydrophilic yarn and a reinforcement yarn, wherein the hydrophilic yarn and the reinforcement yarn are plied together, and wherein the hydrophobic yarn, the hydrophilic yarn, and the reinforcement yarn form a plurality of valleys on an upper surface of the first layer; and a spacer yarn configured to connect the first layer and the second layer.

2. The fabric according to claim 1, further comprising an absorbent layer disposed between the first layer and the second layer.

3. The fabric according to claim 1, wherein the reinforcement yarn is an elastomeric yarn.

4. The fabric according to claim 1, wherein the reinforcement yarn is a shrinkage yarn.

5. The fabric according to claim 1, further comprising a plurality of loops, wherein a cross-sectional area of a valley of the plurality of valleys is at least equal to a cross-sectional area defined by one loop of the plurality of loops.

6. The fabric according to claim 1, wherein a material of yarn of the first layer comprises polyester, nylon, polypropylene, viscose, acrylic, cotton, wool, or a combination thereof.

7. The fabric according to claim 1, wherein a material of yarn of the second layer comprises polyester, nylon, polypropylene, viscose, acrylic, cotton, wool, or a combination thereof.

8. The fabric according to claim 1, wherein a material of the spacer yarn comprises polyester, nylon, polypropylene, viscose, acrylic, cotton, wool, or a combination thereof.

9. The fabric according to claim 1, wherein the spacer yarn is hydrophobic.

10. The fabric according to claim 1, wherein the spacer yarn is hydrophilic.

11. The fabric according to claim 2, wherein the absorbent layer comprises cotton, rayon, or a combination thereof.

12. The fabric according to claim 1, wherein a thickness (T) between the first layer and the second layer is in a range of about 1 mm to 12 mm.

13. A method of making a fabric, the method comprising:

knitting a hydrophobic yarn to form a first layer;

knitting a hydrophilic yarn and a reinforcement yarn together to form a second layer;

connecting the first layer and the second layer using a spacer yarn; and forming a plurality of valleys on an upper surface of the first layer, wherein the hydrophobic yarn, the hydrophilic yarn and the reinforcement yarn form the plurality of valleys.

14. The method according to claim 13, further comprising swapping a plurality of stitches between the first layer and the second layer at predefined locations to form the plurality of valleys.

15. The method according to claim 14, wherein the reinforcement yarn is an elastomeric yarn, and wherein the plurality of stitches between the hydrophobic yarn and the elastomeric yarn are swapped at the predefined locations.

16. The method according to claim 13, further comprising applying a stimulus on the reinforcement yarn to form the plurality of valleys.

17. The method according to claim 13, wherein the reinforcement yarn is a shrinkage yarn.

18. The method according to claim 13, further comprising reducing a loop length of the hydrophilic yarn with respect to a loop length of the hydrophobic yarn to form the plurality of valleys.

19. The method according to claim 13, further comprising inlaying an absorbent layer between the first layer and the second layer.

20. The fabric according to claim 1, wherein the plurality of valleys comprises one or more channels to channel away moisture.

* * * * *